US006205804B1

(12) United States Patent
da Silva

(10) Patent No.: US 6,205,804 B1
(45) Date of Patent: Mar. 27, 2001

(54) COMPRESSOR MOUNTING SYSTEM FOR AN AIR CONDITIONER

(75) Inventor: Regis Batista da Silva, Sao Leopoldo-RS (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/367,588

(22) PCT Filed: Dec. 30, 1997

(86) PCT No.: PCT/BR97/00079

§ 371 Date: Aug. 17, 1999

§ 102(e) Date: Aug. 17, 1999

(87) PCT Pub. No.: WO99/35449

PCT Pub. Date: Jul. 15, 1999

(51) Int. Cl.[7] ..... F25D 23/12
(52) U.S. Cl. ..... 62/262; 62/298
(58) Field of Search ..... 62/262, 298

(56) References Cited

U.S. PATENT DOCUMENTS

| | | | | |
|---|---|---|---|---|
| 4,102,148 | * | 7/1978 | Matthews et al. | 62/77 |
| 5,396,782 | | 3/1995 | Ley et al. | 62/295 |
| 5,711,162 | * | 1/1998 | Wolanin et al. | 62/302 |
| 6,070,424 | * | 6/2000 | Bauman et al. | 62/279 |
| 6,082,127 | * | 7/2000 | Correa | 62/262 |
| 6,098,416 | * | 8/2000 | Addington et al. | 62/298 |

FOREIGN PATENT DOCUMENTS

| | | |
|---|---|---|
| 61-079922 | 4/1986 | (JP) . |
| 2238181 | 9/1990 | (JP) . |
| 3110329 | 5/1991 | (JP) . |
| 9166338 | 6/1997 | (JP) . |

* cited by examiner

*Primary Examiner*—William Doerrler
*Assistant Examiner*—Mark Shulman

(57) ABSTRACT

According to the present invention, an arrangement is provided for mounting compressors on the basepan of an air conditioner which is adapted to use one of two different types of compressors. Each of the compressors is adapted to be mounted in substantially the same region of the basepan. The mounting arrangement includes a first set of compressor mounts attached to the basepan in a mounting region. A second set of compressor mounts is also attached to the basepan in at least a portion of a common section of the mounting region. A first mounting plate is attached to a first compressor which is adapted to be operatively attached to the first set of compressor mounts. The first mounting plate has a lower wall which does not overly any of the second set of compressor mounts. A second mounting plate is attached to the second of the two compressors and is adapted to be operatively attached to the second set of compressor mounts. The second mounting plate has a lower wall which overlies at least one of the compressor mounts of the first set of mounts. The second mounting plate is configured such that its lower wall is in a predetermined spaced relationship with the at least one of the first set of compressor mounts when the second compressor is mounted to the base.

5 Claims, 6 Drawing Sheets

COMPRESSOR MOUNTING SYSTEM FOR AN AIR CONDITIONER

TECHNICAL FIELD

The invention relates to air conditioner and is particularly directed to a method for mounting compressors for an air conditioner to a supporting structure.

BACKGROUND ART

It is well known for air conditioners, such as room air conditioners and split/system air conditioners, to have a compressor mounted to a supporting surface. Such surface is typically a horizontal surface in a section of the air conditioner commonly referred to as the "outdoor section" or the "condensing section".

Since most compressors produce a fair amount of noise and vibration, it is considered desirable to provide a mounting structure for the compressor which serves to isolate the compressor from the supporting structure. Such mounting structure must also be structurally capable of reacting forces caused by adverse handling of the air conditioner unit, such forces include lateral, vertical and torsional forces which might be caused by dropping the unit or mishandling the unit in shipping.

A well known manner of dealing with such forces is to mount the compressor by way of a mounting plate attached to the compressor. The mounting plate in turn is isolated through rubber grommets which are received in mounting studs provided in the mounting structure. Various types of compressors are adapted for use in such air conditioners, for example, rotary compressors and reciprocating compressors may be used satisfactorily in the same air conditioning unit. Such compressors are of different sized and therefore require mounting plates and associated mounting structure to accommodate the different sized compressors.

It is deemed desirable to provided a mounting structure in the basepan of an air conditioner which is adapted to readily receive mounting structure for more than one size compressor while providing adequate support for the compressor during normal operation and during shipping.

DISCLOSURE OF THE INVENTION

According to the present invention, an arrangement is provided for mounting compressors on the basepan of an air conditioner which is adapted to use one of two different types of compressors. Each of the compressors is adapted to be mounted in substantially the same region of the basepan. The mounting arrangement includes a first set of compressor mounts attached to the basepan in a mounting region. A second set of compressor mounts is also attached to the basepan in at least a portion of a common section of the mounting region. A first mounting plate is attached to a first compressor which is adapted to be operatively attached to the first set of compressor mounts. The first mounting plate has a lower wall which does not overly any of the second set of compressor mounts. A second mounting plate is attached to the second of the two compressors and is adapted to be operatively attached to the second set of compressor mounts. The second mounting plate has a lower wall which overlies at least one of the compressor mounts of the first set of mounts. The second mounting plate is configured such that its lower wall is in a predetermined spaced relationship with the at least one of the first set of compressor mounts when the second compressor is mounted to the base.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
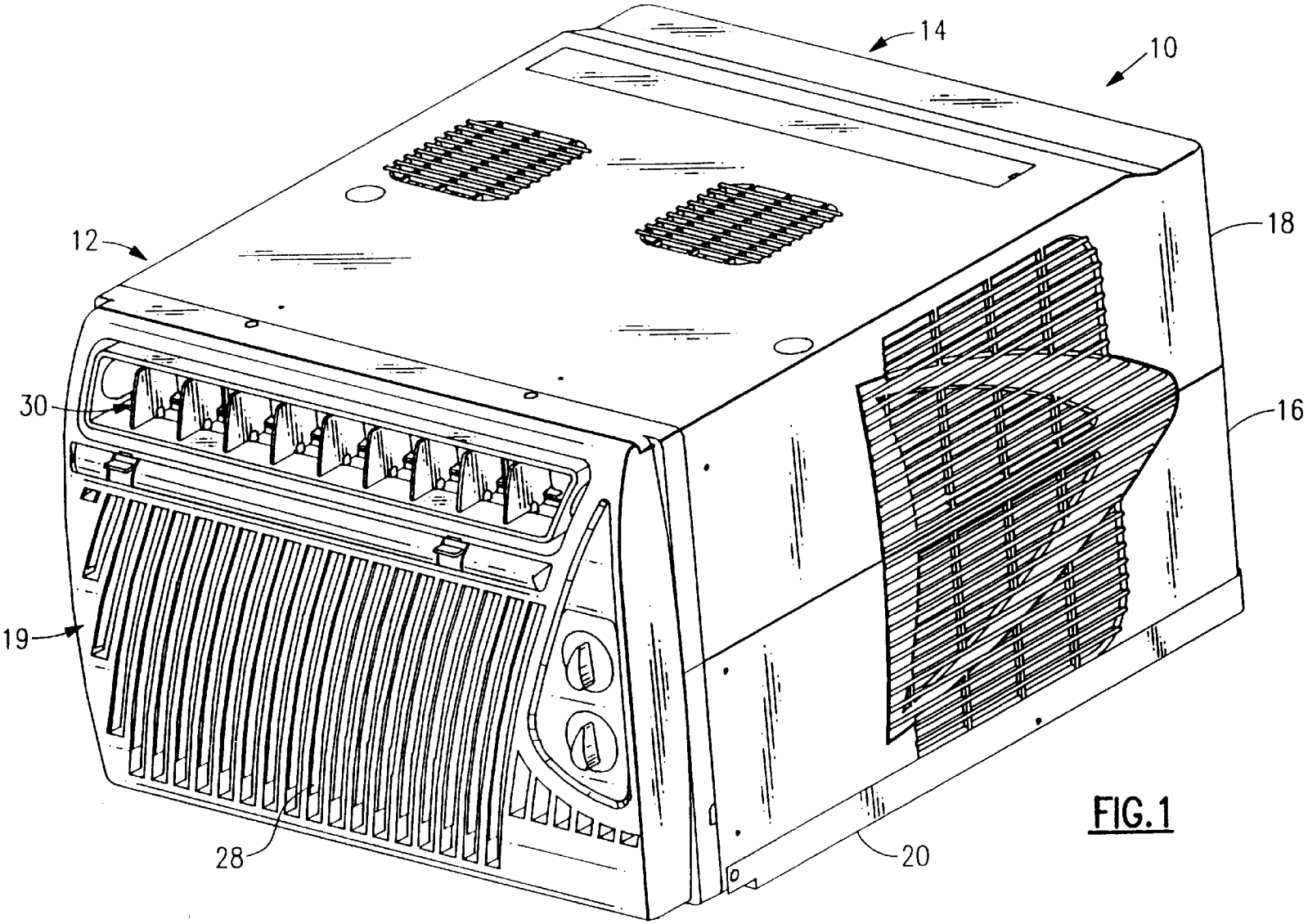
FIG. 1 is a perspective view of a room air conditioner which embodies the features of this invention.

With reference initially to FIG. 1, an air conditioner 10 includes generally an indoor section 12 and an outdoor section 14. The air conditioning unit 10 includes a substantially rectangular housing which includes a lower housing section 16, an upper housing section 18, and an indoor grill section 19. The lower housing section 16 is mounted in a metal support pan 20, and the entire room air conditioner is adapted to be positioned in a rectangular opening in an exterior wall or on a windowsill in a room where cooling is desired, with the indoor grill section 19 facing into the room as is conventional.

Figure 2:
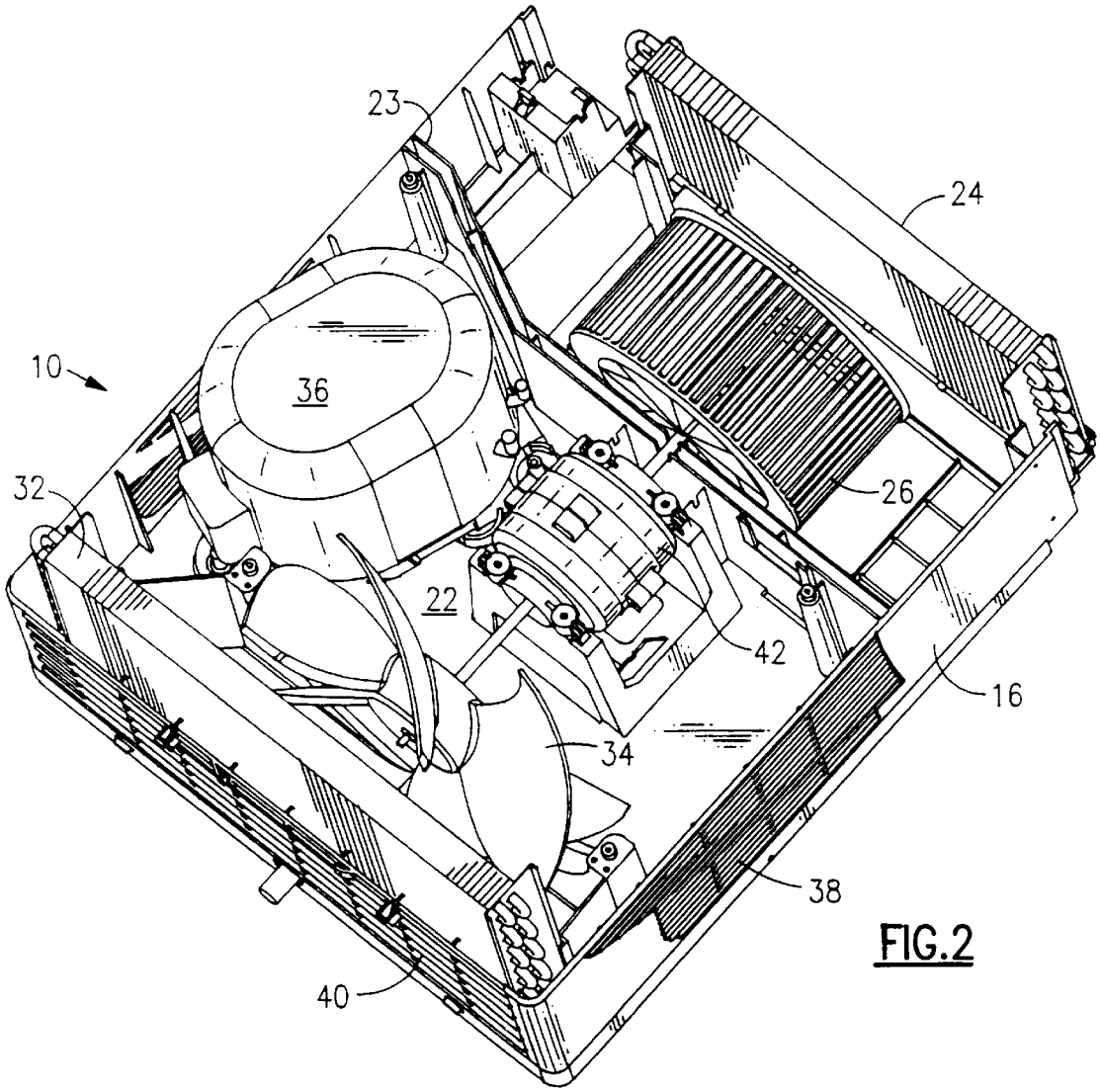
FIG. 2 is a perspective top view of a room air conditioner of the type shown in FIG. 1 with the upper cover and front grill removed therefrom.

The housing sections 12 and 14 and the grill 19 are preferably made from a molded plastic material. As best seen in FIGS. 2 through 7, the entire air conditioning unit 10 is supported on a plastic basepan 22 molded integrally with and forming the bottom of the lower housing 14. Extending upwardly from the basepan 22 and integrally formed with the side walls of the lower housing 16 is a vertically extending partition 23 which separates the indoor 12 and outdoor 14 sections. FIG. 2 illustrates the unit 10 with the upper housing 18 and the indoor grill 19 removed. Again, as is conventional, the unit includes an indoor refrigerant to air heat exchanger or evaporator 24 and an evaporator fan 26. Air from the spaced to be conditioned by the system is drawn by action of the evaporator fan 26, through inlet louvers 28 formed in the indoor grill section 19 and is directed through the evaporator coil 24 where the air is cooled. The cooled air is then directed back into the space to be cooled through an indoor conditioned air discharge assembly 30 forming part of the grill 19.

With continued reference to FIG. 2, the unit also includes an outdoor refrigerant to air heat exchanger or condenser coil 32, a condenser fan 34 and a compressor 36. In operation, ambient air enters the outdoor portion of the housing through a number of louvered air inlets 38 located in the top and sides of the housing sections 14 and 16. The air entering the inlets 38 is then drawn through the outdoor fan 34 and is directed through the condenser coil 32 before exiting through discharge openings 40 in the back of the housing. As best seen in FIG. 2, both the evaporator fan 26 and the condenser fan 34 are driven from opposite ends of a single draft shaft of a common drive motor 42 mounted in the outdoor section 14 of the housing.

The compressor 36 illustrated in FIG. 2 is representative of a reciprocating type compressor commonly used in such applications and which is mounted through a basepan and vibration isolating structure to compressor support structure molded directly into the plastic basepan 22. As will be pointed out in detail hereinbelow, the compressor mounting structure of the present invention is designed to allow the mounting of a reciprocating type compressor as well as a rotary type compressor, which is substantially smaller is size, while making use of some common attachment structure and compressor stabilizing structure, all molded into the basepan.

Figure 3:
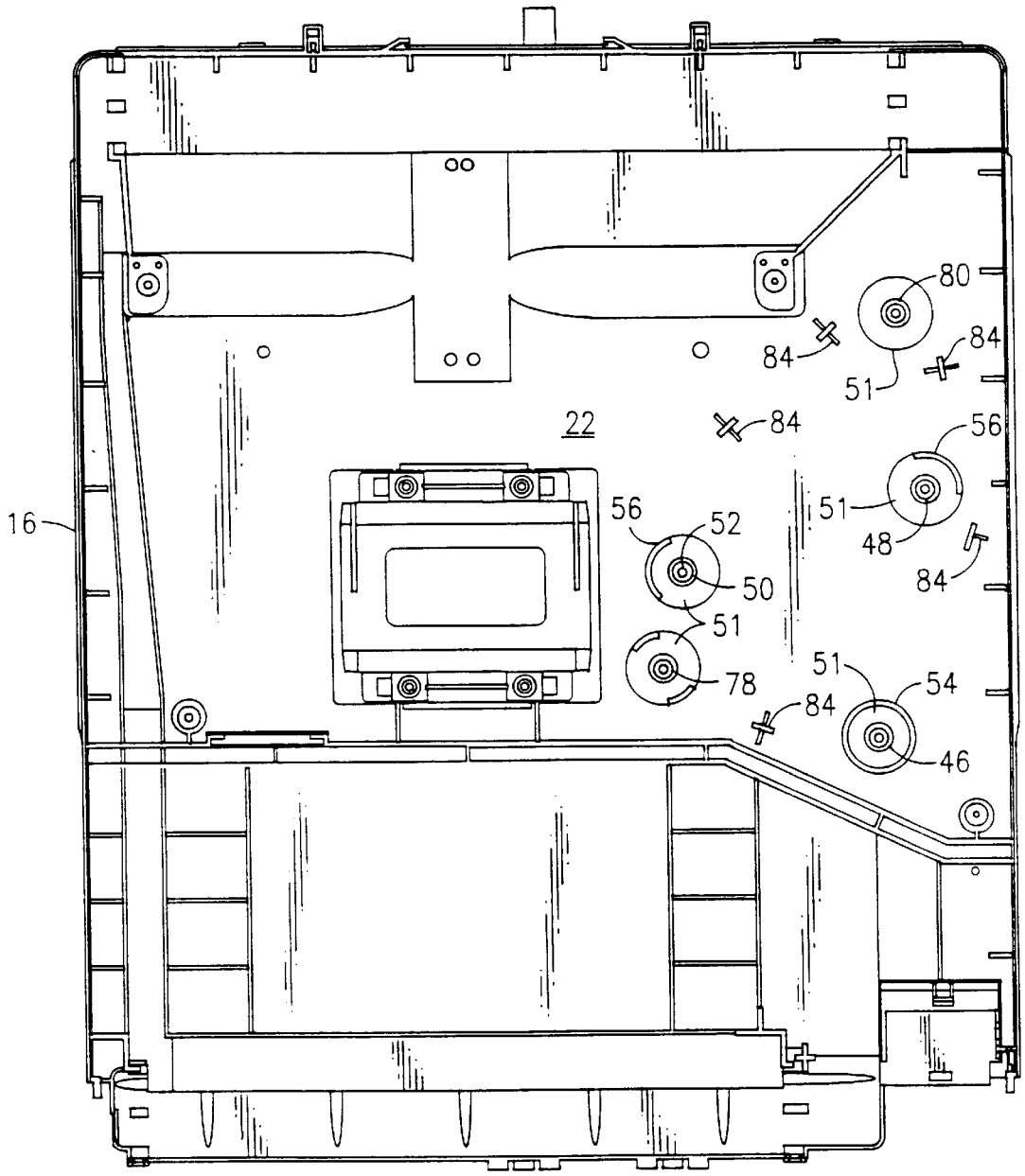
FIG. 3 is a top plan view of air conditioner of the type shown in FIG. 1 with most of the internal components removed therefrom.

Looking now at FIG. 3, five compressor mounting studs are illustrated, each of which is integrally structurally molded into the plastic metal basepan 22. As will be noted, each of the studs and associated support structure is different.

Figure 4:
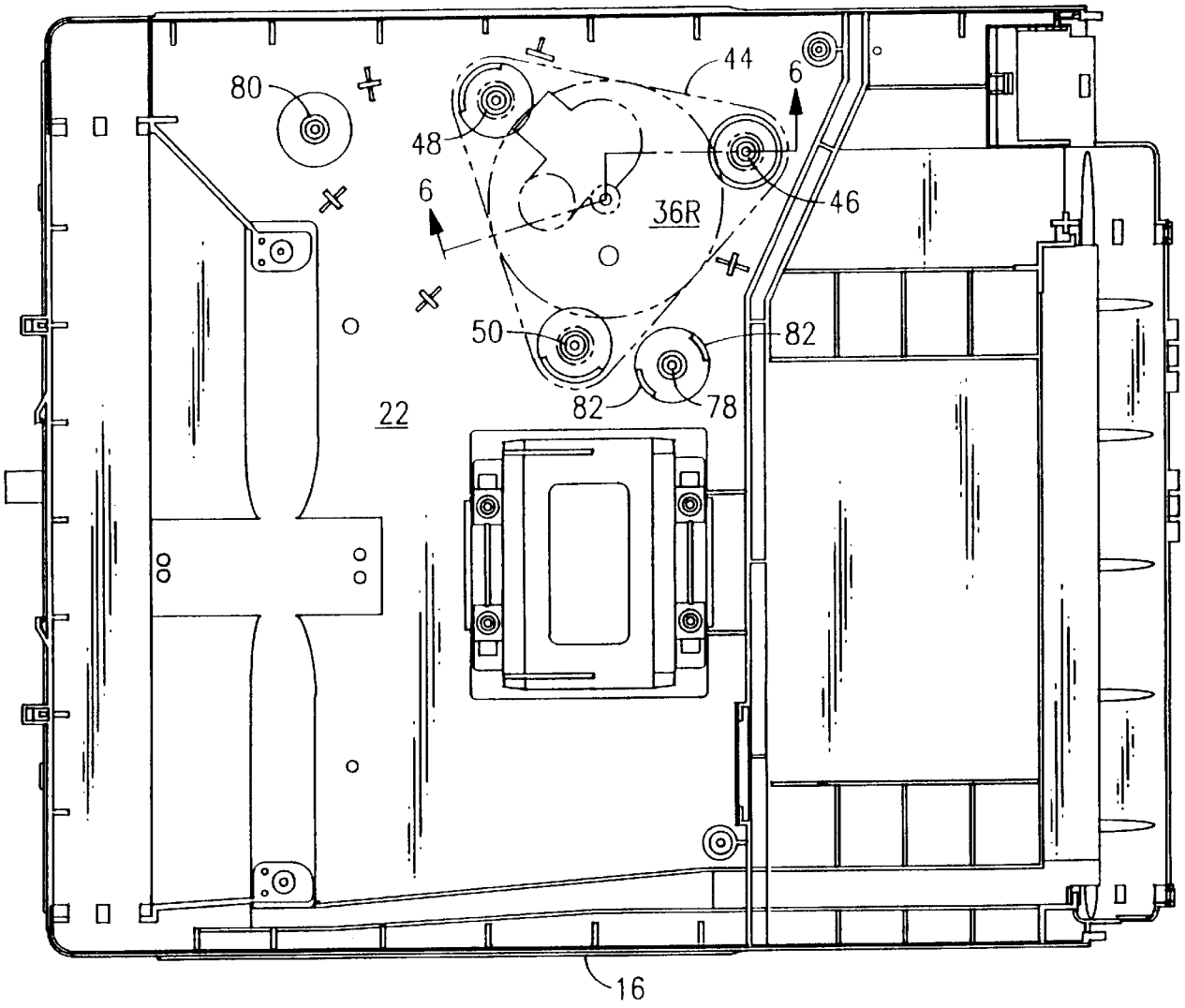
FIG. 4 is a view similar to FIG. 3 illustrating one type of compressor mounted therein.
Figure 6:
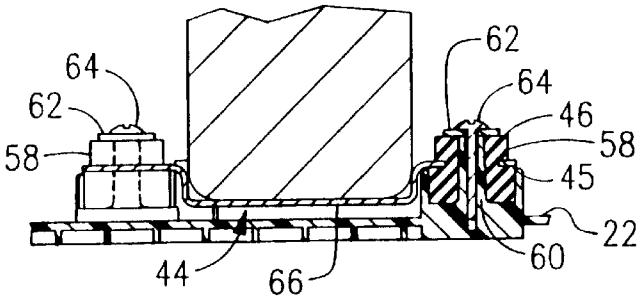
FIG. 6 is a sectional view taken along the line 6—6 of FIG. 4.

With reference to FIGS. 4 and 6, mounting of a rotary compressor 36R will first be described. The compressor 36R has a substantially triangularly shaped mounting plate 44 attached thereto. The mounting plate 44 has openings 45 at each of the three corners thereof to facilitate attachment to the basepan 22. Three mounting studs 46, 48 and 50 are integrally molded into the basepan 22 at spaced locations such that one is in axial alignment with each of the openings 45 in the mounting plate 44. It will be noted that each of the studs 46, 48 and 50 is surrounded by a vertically extending raised portion 51 which forms a reinforcement at the point that the studs are molded into the base.

Each of the studs 46, 48 and 50 includes an axially extending opening 52 therein which is adapted to receive a threaded mounting screw as will be seen. Looking now at the individual studs, stud 46 includes a circular raised wall 54 coaxially surrounding the stud which is also molded directly into the basepan 22. Studs 48 and 50 are each provided with a vertically arcuately shaped projection 56. The arcuate projections 56 are oriented at a location spaced rearwardly from the stud with respect to the other two studs. The height of the wall 54 and the vertically extending projections 56 is less than that of the studs.

Mounting of the compressor 36R and mounting plate 44 is accomplished by first assembling elastomeric isolator bushings 58 to each of the three openings 45 provided in the compressor plate 44, as illustrated in FIG. 6. The mounting plate 44, with the compressor mounted thereupon, is then set in place with the three integrally formed studs 46, 48 and 50 extending through axially aligned openings 60 provided in each of the bushings 58. The diameter of the elastomeric bushings is such that when the studs are received therein, the outer circumference of each bushing is in close contact with the inner surface of either the circular wall 54 or the arcuate projections 56 walls 54 associate with the stud to which the bushing has been assembled.

A single "fender" washer 62 is then placed over each of the bushings with its central opening in alignment with the axial opening 52 in each of the studs. A simple sheet metal screw 64 is then threaded directly into the opening 52 in the stud and tightened to a predetermined torque to avoid stripping of the threads formed within the openings as the screw is attached thereto.

With continued reference to FIGS. 4 and 6, it will be noted that the mounting plate 44 for the rotary compressor 36R is formed with a circularly shaped, centrally positioned, downwardly extending extension 66 which is adapted to receives the lower part of the compressor therein. As seen in FIG. 6, the bottom of the central depressed portion 66 is closely spaced to the basepan 22 to which the compressor is mounted.

As a result of the above relationship, the mounting of the compressor through the base 44 and the elastomeric bushings will react horizontal and vertical forces imparted upon the compressor during operation and during shipping through the bushings to the stud and associated wall structures 54 and 56. Also, particularly during shipping, when the air conditioner is susceptible to rough handling, any tendency of the compressor to tilt off of its vertical axis and thereby stress and possibly damage the mounting structure will be resisted by contact of the bottom of the lower portion of the base directly with the basepan 22.

Figure 5:
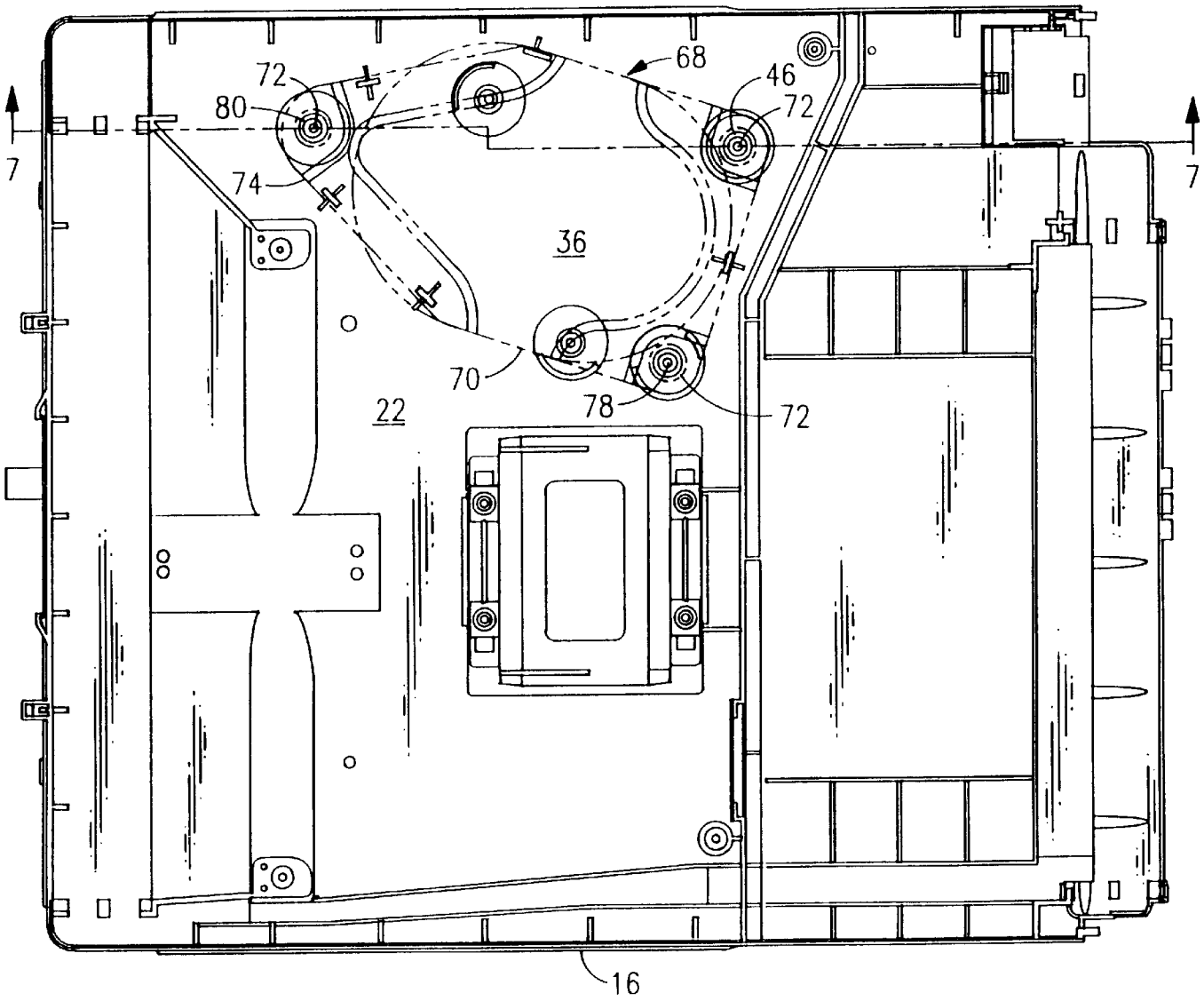
FIG. 5 is a view similar to FIG. 4 showing another type of compressor mounted therein.
Figure 7:
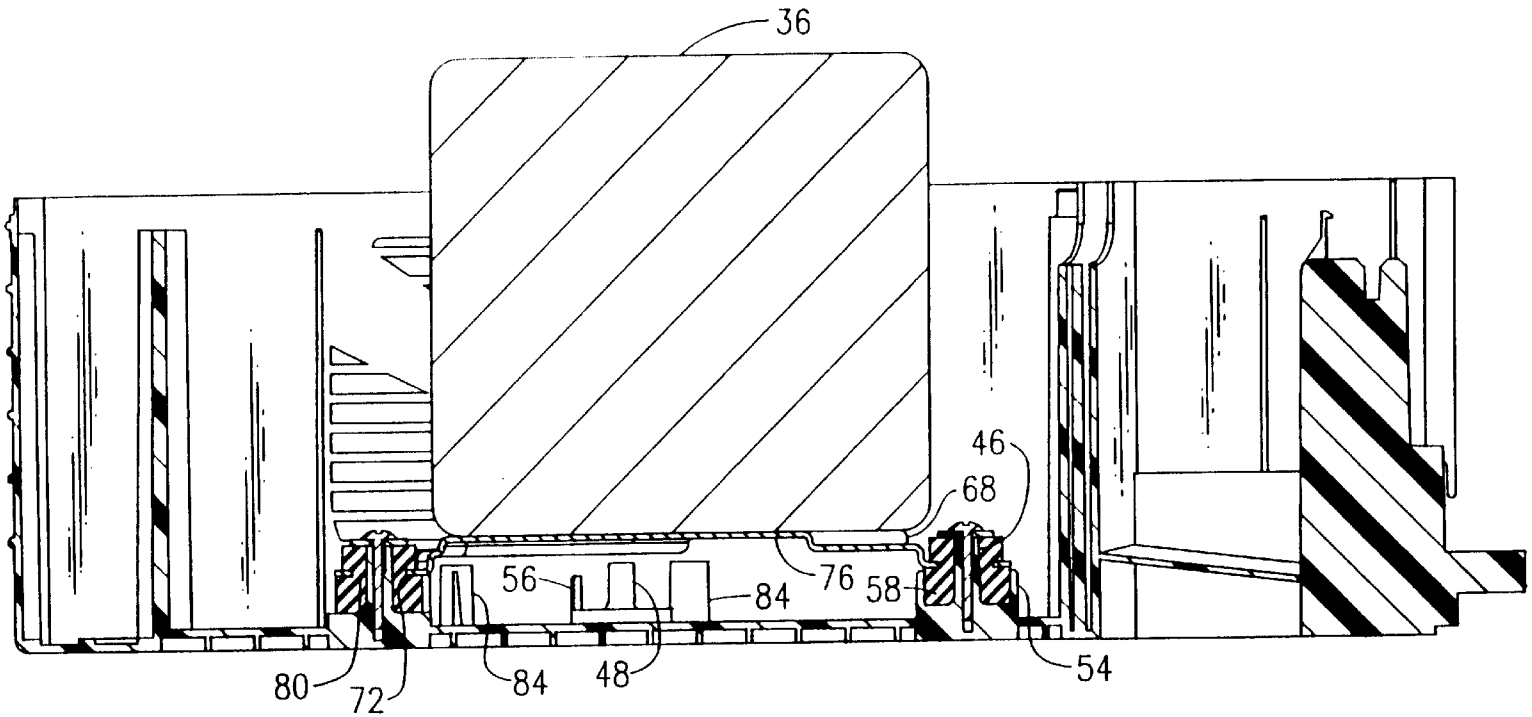
FIG. 7 is a sectional view taken along the line 7—7 of FIG. 5.

Looking now at FIGS. 3, 5 and 7, the mounting of a reciprocating compressor 36 to the basepan 22 will be described in detail. The compressor 36 has a compressor mounting plate 68, which has a substantially rectangular section 70 having two mounting openings 72 at one end thereof and narrowed down end section 74 having a third mounting opening 72 therein. As best seen in FIG. 7, the sections of the compressor mounting plate 68 which are adapted to engage compressor mounting studs are located at an elevation above the basepan substantially the same as that of the mounting plate 44 for the rotary compressor. The compressor supporting portion of the plate 76, however, is at a substantially higher elevation than the portion of the plate that engages the mounting structure. As a result, the central portion of the compressor mounting plate 76 is spaced a substantial distance from the basepan 22.

Mounting of the compressor mounting plate 68 to the basepan 22 is accomplished using previously described mounting stud 46 and two additional studs 78 and 80. Each of studs 78 and 80 is surrounded by the same vertically extending raised portion 51 as described above in connection with the other mounting studs. Stud 78 is provided with a pair of vertically extending arcuate projections 82 similar to those described in connection with studs 48 and 50. The stud 80 has no arcuate support structure associated therewith.

Mounting of the compressor 36 is accomplished in the same manner as described above in connection with the mounting of the rotary compressor using elastomeric isolator bushings 58, fender washer 62 and metal attaching screws 64. Accordingly, the reciprocating compressor is mounted as illustrated in FIGS. 5 and 7 with the raised portion 76 of the mounting plate 68 in overlying relationship to the basepan 22 and compressor mounting studs 48 and 50. Also integrally formed with the basepan 22 are five vertically extending substantially X-shaped structural elements 84. It will be noted that these elements are positioned about the periphery of the compressor mounting plate 68 and extend to an elevation underlying the compressor mounting plate such that the plate is spaced from the top of the elements 84 a distance substantially equal to the spacing between the compressor mounting plate 44 of the rotary compressor from the basepan 22.

Further, it will be noted that compressor mounting studs 48 and 50 extend to a height less than that of compressor mounting stud 46. As best seen in FIG. 7, the height of these studs is the same as that of the upstanding structural supports 84. As a result, while the reciprocating compressor is mounted substantially higher from the basepan 22, the spacing from the raised portion 76 of the mounting plate to the tops of the structural elements 84 and the tops of the studs 48 and 50 is substantially the same as the spacing of the rotary compressor mounting plate 44 from the basepan 22.

Accordingly, the mounting of the reciprocating compressor through the compressor mounting plate 68 and the elastomeric bushings will react horizontal and vertical forces imparted upon the reciprocating compressor during operation and during shipping through the bushings to the stud and associated wall structures 54 and 82. Also, during shipping, when the air conditioner is susceptible to rough handling, any tendency of the compressor to tilt off of its vertical axis and thereby stress and possibly damage the mounting structure will be resisted by contact of the bottom of the raised portion 76 of the compressor mounting plate 68 with the tops of the structural elements 84 and the tops of the unused mounting studs 48 and 50.

What is claimed is:

1. An arrangement for mounting compressors on the basepan of an air conditioner, the air conditioner being adapted to use one of two different types of compressors therein, each compressor being adapted to be mounted in substantially the same region of said basepan wherein the improvement comprises:

a first set of compressor mounts attached to said basepan in said region;

a second set of compressor mounts attached to said basepan in at least a portion of a common section of said region;

a first mounting plate attached to a first of said two compressors and adapted to be operatively attached to said first set of compressor mounts, said first mounting plate having a lower wall which does not overly any of said second set of compressor mounts; and a second mounting plate attached to the second of said two compressors and adapted to be operatively attached to said second set of compressor mounts, said second mounting plate having a lower wall which overlies at least one of said compressor mounts of said first set of compressor mounts, said second mounting plate being configured such that said lower wall is in a predetermined spaced relationship with said at least one of said compressor mounts when said second compressor is mounted to said base.

2. The apparatus of claim 1 wherein at least one of said compressor mounts in said second set of compressor mounts is common with a compressor mount of said first set of compressor mounts.

3. The apparatus of claim 1 wherein each of said first and second sets of compressor mounts are adapted to engage said first and second mounting plates by way of a vibration isolating structure, said structure being adapted to vertically and horizontally restrain said first and second compressors when they are mounted to said basepan, said mounting structures allowing tilting of said compressor and said basepan during adverse handling of said air conditioning unit;

wherein said lower wall of said first mounting plate is spaced from said basepan a distance whereby said lower wall will contact said basepan to prevent tilting of said compressor during adverse handling thereof.

4. The apparatus of claim 2 further including at least one vertically extending element molded into said basepan underlying said lower wall of said second mounting plate, said element having an upper end thereof which is spaced from said lower wall by said predetermined spaced relationship.

5. The apparatus of claim 4 wherein said lower wall of said first mounting plate is spaced from said basepan a distance whereby said lower wall will contact said basepan to prevent tilting of said compressor during adverse handling thereof;

wherein said lower wall of said second mounting plate is spaced from said at least one of said compressor mounts and said upper ends of said vertically extending elements by a distance whereby said lower wall will contact said at least one compressor mount or said vertically extending elements to prevent tilting of said compressor during adverse handling thereof.

* * * * *